US007383001B2

(12) United States Patent
Fukao

(10) Patent No.: US 7,383,001 B2
(45) Date of Patent: Jun. 3, 2008

(54) IMAGE FORMING METHOD AND APPARATUS CAPABLE OF EFFECTIVELY POSITIONING A CLEANING UNIT

(75) Inventor: Takeshi Fukao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 114 days.

(21) Appl. No.: 11/385,888

(22) Filed: Mar. 22, 2006

(65) Prior Publication Data

US 2006/0216057 A1 Sep. 28, 2006

(30) Foreign Application Priority Data

Mar. 22, 2005 (JP) ..... 2005-080809
May 9, 2005 (JP) ..... 2005-135683

(51) Int. Cl.
*G03G 21/00* (2006.01)
*G03G 15/16* (2006.01)

(52) U.S. Cl. ..... 399/123; 399/101

(58) Field of Classification Search ..... 399/101, 399/123, 302, 308, 121
See application file for complete search history.

(56) References Cited

U.S. PATENT DOCUMENTS 6,445,900 B2 9/2002 Fukao et al.
6,704,528 B1 * 3/2004 Kawamura et al. ..... 399/123
6,865,361 B2 * 3/2005 Abe et al. ..... 399/302
6,868,248 B2 3/2005 Fukao et al.
2004/0136763 A1 * 7/2004 Murakami et al. ..... 399/350
2006/0072929 A1 * 4/2006 Takahashi ..... 399/123 X

FOREIGN PATENT DOCUMENTS

JP 5-323704 12/1993
JP 2001-75374 3/2001
JP 2003-122228 4/2003
JP 2003-216001 7/2003
JP 2004-70305 3/2004
JP 2004-151206 5/2004
JP 2004-170439 6/2004
JP 2004-258357 A * 9/2004

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus and corresponding method, the apparatus including at least one image bearing member configured to bear an image, an intermediate transfer member configured to transfer the image formed on the at least one image bearing member, a roller configured to support the intermediate transfer member with tension, a cleaning unit disposed opposite to the roller and configured to remove residual toner from the intermediate transfer member, and is detachably disposed opposite to the roller, a holder configured to accommodate the roller, and a positioning member detachably mounted on the holder and configured to position the cleaning unit to a positioning reference.

21 Claims, 5 Drawing Sheets

IMAGE FORMING METHOD AND APPARATUS CAPABLE OF EFFECTIVELY POSITIONING A CLEANING UNIT

CROSS REFERENCE TO RELATED APPLICATIONS

The present application claims priority to Japanese patent application no. 2005-080809, filed in the Japan Patent Office on Mar. 22, 2005, and Japanese patent application no. 2005-135683, filed in the Japan Patent Office on May 9, 2005, the disclosures of which are incorporated by reference herein in their entirety.

BACKGROUND OF THE INVENTION

1. Field of the Invention

The present invention relates to an image forming method and apparatus capable of effectively positioning a cleaning unit. More specifically, the present invention relates to an image forming apparatus including a cleaning unit detachably provided thereto and effectively positioned based on a positioning reference, a cleaning unit provided to the image forming apparatus, and a method of positioning the cleaning unit.

2. Discussion of the Related Art

JP 05-323704 discloses an image forming apparatus with an intermediate transferring system includes, for example, a photoconductive drum serving as an image bearing member and bearing a toner image on the photoconductive drum according to a corresponding electrostatic latent image, an intermediate transfer member serving as an intermediate transfer member and receiving the toner image formed on a surface of the photoconductive drum, a primary transfer member transferring the toner image from the photoconductive drum onto the intermediate transfer belt, and a secondary transferring member transferring the toner image from the intermediate transfer belt onto a recording medium. When the background image forming apparatus includes a tandem-type system, a plurality of photoconductive drums are provided to form respective toner images.

The intermediate transfer belt includes a plurality of layers. The plurality of layers includes a base layer produced by a partially elastic material, for example, a fluorocarbon resin, a polyvinylidene sheet, a polyimide resin, and the like, and a surface layer or a coated layer produced by a resin having a smoothing ability, for example, a fluorocarbon resin.

In the background image forming apparatus, the toner images formed on the respective surfaces of the plurality of photoconductive drums are transferred onto the intermediate transfer belt to form an overlaid toner image as a primary transfer, and then the overlaid toner image is transferred onto the recording medium as a secondary transfer. After the secondary transfer is performed, toner remaining on the intermediate transfer belt is removed by a cleaning unit. The cleaning unit employs a method of removing residual toner, for example, by scraping the toner physically with a cleaning blade and/or by removing residual toner statically with a brush roller.

Recently, there is a strong demand that image forming apparatuses using an electrostatic copying method have better image forming productivity. To respond the above-described demand, toner that reacts well to the the electrostatic latent image has been studied. This new toner has greater sphericity and smaller particle diameter so as to form higher definition images. However, the smaller particle diameter makes it more difficult to remove residual toner from an intermediate transfer belt. Therefore, the new toner requires that the cleaning unit be replaced within a predetermined period of maintenance appropriate for the new toner. When the life of the cleaning unit is shorter than the other units in the image forming apparatus, it is more preferable that the cleaning unit is replaced separately from the other units.

In the previously described conventional tandem image forming apparatus (i.e., multi-color), the image forming apparatus includes a plurality of photoconductive drums corresponding to respective colors such as black, yellow, magenta, cyan, and the like. Because of the presence of the plurality of photoconductive drums, space for other units becomes limited. To accommodate this reduced space, the cleaning member is disposed opposite to a tension roller supporting the intermediate transfer belt with tension. The position of the tension roller, however, varies according to a circumferential length of the intermediate transfer belt. Thus, it is difficult to mount the cleaning member in an easily detachable manner to the image forming apparatus. Furthermore, it is more difficult to position the cleaning member according to the tension roller in an axial direction of the tension roller.

To solve the above-described problem regarding the positioning of the cleaning member, and to allow easier installation and removal, JP 2001-075374 has proposed a technique whereby a tension roller supporting an intermediate transfer belt is held by a holding member via a rotative shaft of the tension roller to be movable in one direction. By positioning the cleaning unit by the holding member, the cleaning member can effectively contact the intermediate transfer belt.

JP 2004-070305 has proposed another technique whereby a process cartridge including at least a plurality of electrostatic image bearing members and an intermediate transfer member is detachably disposed in an image forming apparatus. The plurality of electrostatic image bearing members and a supporting shaft of the intermediate transfer member are preliminarily positioned to the process cartridge. When the process cartridge is mounted on a predetermined position, the plurality of electrostatic image bearing members and the supporting shaft of the intermediate transfer member are properly positioned by a first positioning member mounted on the image forming apparatus. Thus, the plurality of electrostatic image bearing members and the supporting shaft of the intermediate transfer member are positioned in high precision with a simple structure.

However, the previously identified conventional approaches are deficient because they are prone to errors in positioning the cleaning unit. Thus, what is desired, as discovered by the present inventors is an image forming method and apparatus capable of effectively positioning a cleaning unit.

SUMMARY OF THE INVENTION

The present invention has been made in view of the above-mentioned circumstances.

An object of the present invention is to provide a novel image forming apparatus that can prevent positioning error of a cleaning unit and provide an easy replacement thereof.

Another object of the present invention is to provide a method of positioning the cleaning unit into the above-described novel image forming apparatus.

Another object of the present invention is to provide a novel cleaning unit having an engaging member to be engaged with an engaging member provided with the above-described novel image forming apparatus to be properly positioned to a positioning reference.

In one embodiment, an image forming apparatus has at least one image bearing member configured to bear an image, an intermediate transfer member configured to transfer the image formed on the at least one image bearing member, a roller configured to support the intermediate transfer member with tension, a cleaning unit disposed opposite to the roller and configured to remove residual toner from the intermediate transfer member, and detachably disposed opposite to the roller, a holder configured to accommodate the roller, and a positioning member detachably mounted on the holder and configured to position the cleaning unit to a positioning reference.

The positioning member may position the cleaning unit to a main positioning reference of the reference position in an axial direction of the roller.

The cleaning unit may include a first engaging member and the positioning member includes a second engaging member.

The first engaging member of the cleaning unit may be engaged with the second engaging member of the positioning member so that the cleaning unit is properly positioned.

The positioning member further may include a guiding member with a tapered portion and configured to guide the cleaning unit to the positioning reference. The cleaning unit may include a guiding member receiving portion with a tapered portion and configured to receive the guiding member.

The cleaning unit may be horizontally moved from a center target point by an average travel distance "a" according to a pressure applied by the roller. The guiding member may have a tapered portion with a distance different from first and second distances from a center thereof by a distance "b" between the first and second distances.

The average travel distance "a" and the distance "b" of the tapered portion of the guiding member may have a relationship of $a \leqq b$.

The above-described image forming apparatus may use toner having a volume-based average particle diameter from approximately 3 μm to approximately 8 μm and a distribution from approximately 1.00 to approximately 1.40, and the distribution may be defined by a ratio of the volume-based average particle diameter to a number-based average diameter.

The above-described image forming apparatus may use toner having a shape factor "SF-1" in a range from approximately 100 to approximately 180, and a shape factor "SF-2" in a range from approximately 100 to approximately 180.

The above-described image forming apparatus may be configured to use toner obtained from at least one of an elongation and a crosslinking reaction of toner composition comprising a polyester prepolymer having a function group including a nitrogen atom, a polyester, a colorant, and a releasing agent in an aqueous medium under resin fine particles.

The above-described image forming apparatus may be configured to use toner having a spindle outer shape.

The above-described image forming apparatus may uses toner having a ratio of a major axis r1 to a minor axis r2 from approximately 0.5 to approximately 1.0, and a ratio of a thickness r3 to the minor axis r2 from approximately 0.7 to approximately 1.0, and $r1 \geqq r2 \geqq r3$.

Further, in one embodiment, a method of positioning the cleaning unit to the above-described novel image forming apparatus includes mounting a positioning member detachably on a holder attached to a transfer unit of the image forming apparatus, inserting the cleaning unit into the image forming apparatus horizontally from one side of the image forming apparatus to an opposite side of the image forming apparatus, moving the cleaning unit horizontally toward the transfer unit, engaging a guiding member of the positioning member with a guiding member receiving portion of the cleaning unit, and engaging a first engaging member of the cleaning unit with a second engaging member of the positioning member.

Further, in one embodiment, a cleaning unit is detachably mounted on an image forming apparatus and disposed opposite to a roller supporting an intermediate transfer member includes a first engaging member configured to engage with a second engaging member included in a positioning member mounted on a holder accommodating the roller, and a guiding member receiving portion with a tapered portion configured to receive a guiding member mounted on the positioning member. The cleaning unit may be guided by the holder and the positioning member so that the cleaning unit is positioned to a positioning reference.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
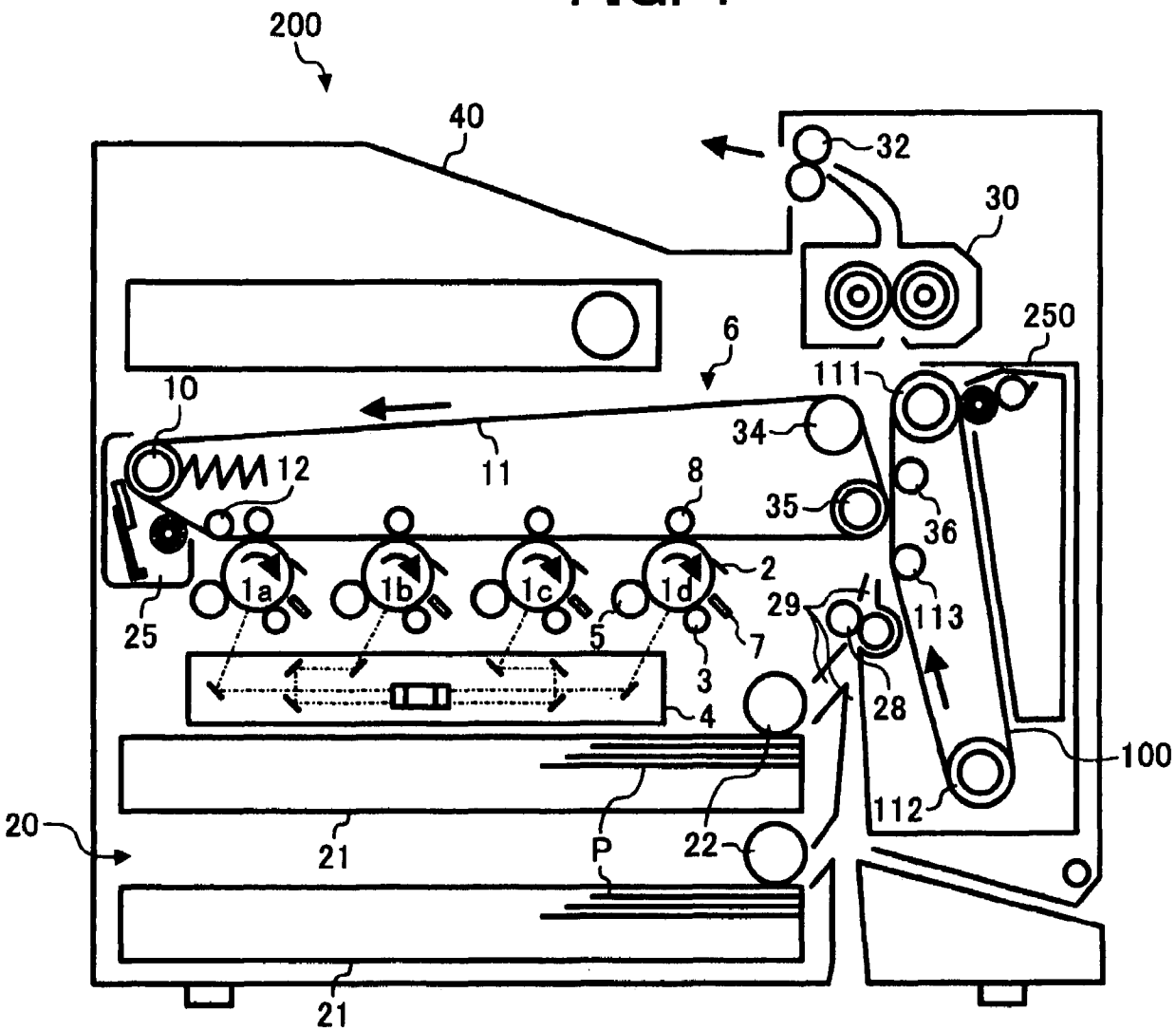
FIG. 1 is a schematic structure of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a structure of an image forming apparatus 200 according to an exemplary embodiment of the present invention is described. The image forming apparatus 200 is a tandem-type image forming apparatus with an indirect system.

In FIG. 1, the image forming apparatus 200 includes four photoconductive elements 1*a*, 1*b*, 1*c* and 1*d*, serving as image bearing members. Hereafter, each of the photoconductive elements 1*a*, 1*b*, 1*c*, and 1*d* may be referred to generally as photoconductive element 1 when the features of elements 1*a*, 1*b*, 1*c*, and 1*d* are common to each other. The four photoconductive elements 1*a*, 1*b*, 1*c*and 1*d* have similar structures and functions, except that respective toners are of different colors, which are yellow, cyan, magenta and black toners. The discussion below uses reference numerals for specifying components of the image forming apparatus 200 without suffixes. The image forming apparatus 200 further includes image forming components such as an image bearing member cleaning unit 2, a charging unit 3, an optical writing unit 4, a developing unit 5, a transfer unit 6, and a lubricant supplying unit 7. The image bearing member cleaning unit 2, the charging unit 3, and the developing unit 5 are arranged around the photoconductive element 1, which forms a tandem-type image forming mechanism.

The image bearing member cleaning unit 2 is arranged on an outer side of the belt loop of an intermediate transfer member 11 of the transfer unit 6 to remove residual toner remaining on a surface of the photoconductive element 1.

The charging unit 3 uniformly charges a surface of the photoconductive element 1.

The optical writing unit 4 is disposed below the tandem-type image forming apparatus 200.

A portion formed between the image bearing member charging unit 3 and the developing unit 5 is secured an optical path for allowing optical data output by the optical writing unit 4 to pass through there.

The optical writing unit 4 includes a widely known laser method in which optical data corresponding to color image forming is emitted in a form of a laser beam. The laser beam irradiates an electrostatic latent image on the photoconductive element 1 having a uniformly charged surface. As an alternative, the optical writing unit 4 may have LED array and imaging unit.

The developing unit 5 develops the electrostatic latent image formed on the surface of the photoconductive element 1 to a visible toner image.

The lubricant supplying unit 7 containing lubricant is arranged separately from the image bearing member cleaning unit 2.

As shown in FIG. 1, the photoconductive element 1 is rotatably provided to the image forming apparatus 200 and rotates in a direction indicated by an arrow in FIG. 1. A surface of the photoconductive element 1 is partly held in contact with a surface of an intermediate transfer member 11 included in the transfer unit 6. Further, while a drum-type photoconductive element is employed in FIG. 1, a belt-type photoconductive element may alternatively be applied to the image forming apparatus 200 of the present invention.

The intermediate transfer member 11 includes a plurality of layers. The plurality of layers includes a base layer produced by an inextensive material, for example, a fluorocarbon resin, a polyvinylidene sheet, a polyimide resin, and the like, and a surface layer or a coated layer produced by a resin having a smoothing ability, for example, a fluorocarbon resin. The intermediate transfer member 11 is arranged above the photoconductive elements 1*a*, 1*b*, 1*c* and 1*d*, and is spanned around a plurality of supporting rollers such as a tension roller 10, a drive roller 34, and driven rollers 12 and 35. The intermediate transfer member 11 forms an endless belt extended with the tension roller 10, the drive roller 34, and the driven rollers 12 and 35, and is movable in a counterclockwise direction indicated by an arrow in FIG. 1.

On the intermediate transfer member 11 between the driven rollers 12 and 35, the four photoconductive elements 1*a*, 1*b*, 1*c*, and 1*d* having respective colors such as black, yellow, magenta, and cyan are disposed in a horizontal manner along a travel direction of the intermediate transfer member 11.

A primary transfer roller 8 serving as a primary transfer mechanism is arranged in a vicinity of the photoconductive element 1, and is held in contact with an inside surface of a belt loop of the intermediate transfer member 11.

A primary transfer roller 8 serving as a primary transfer mechanism is arranged in a vicinity of the photoconductive element 1, and is held in contact with an inside surface of a belt loop of the intermediate transfer member 11.

A secondary transfer mechanism is arranged at a right portion of the image forming apparatus 200. The secondary transfer mechanism includes a conveyance belt 100, a secondary transfer member 36, and rotation rollers 111, 112, and 113.

The conveyance belt 100 is rotatably movable in a direction indicated by an arrow in FIG. 1, and forms an endless belt extended with the rotation rollers 111, 112, and 113.

The secondary transfer member 36 is disposed opposite to the drive roller 34 of the transfer unit 6 of FIG. 1. The secondary transfer member 36 may include a roller. The secondary transfer member 36 is held in contact with an inside surface of a belt loop of the conveyance belt 100.

Above the secondary transfer member 36 is a fixing unit 30. The fixing unit 30 includes a fixing roller (not shown) and a pressure roller (not shown) to fix a recording medium having a toner image thereon through the application of heat and pressure.

The secondary transfer mechanism further includes a sheet conveying mechanism that conveys the recording medium to the fixing unit 30 after the recording medium receives the toner image thereon from the intermediate transfer member 11.

As an alternative, the above-described secondary transfer mechanism may include a transfer roller, a non-contact charger, and the like. In that case, however, it may be difficult that the secondary transfer mechanism performs as the sheet conveying mechanism.

The image forming apparatus further includes a sheet feeding mechanism 20. The sheet feeding mechanism 20 includes sheet feeding cassettes 21 accommodating respective recording media including a recording medium P, and respective pickup rollers 22.

Now, operations of image forming according to the exemplary embodiment of the present invention are described. The description is made focusing on one of the photoconductive elements 1*a*, 1*b*, 1*c*, and 1*d* since the structures of the photoconductive elements 1*a*, 1*b*, 1*c*, and 1*d* are similar, except toners having different colors.

When a start switch (not shown) is pressed, the intermediate transfer member 11 starts rotating. Concurrently, the optical writing unit 4 emits a laser beam from corresponding optical data. The laser beam travels through optical components and reaches the photoconductive element 1. The surface of the photoconductive element 1 is uniformly charged with a predetermined voltage by the charging unit 3. The laser beam emitted from the optical writing unit 4 irradiates the surface of the photoconductive element 1 to, according to image data corresponding to each toner color, form an electrostatic latent image. The electrostatic latent image is visualized by the developing unit 5 as a toner image.

After the toner image is formed on the photoconductive element 1, the toner image is attracted by an electrostatic force exerted by the primary transfer roller 8, and is transferred onto a surface of the intermediate transfer member 11 which moves in synchronization with the photoconductive element 1. The image bearing member cleaning unit 2 removes residual toner on the surface of the photoconductive element 1 for preparing a next image forming operation.

After the image bearing-member cleaning unit 2 cleaned the surface of the photoconductive element 1, the lubricant is supplied from the lubricant supplying unit 7 to the surface of the photoconductive element 1.

The toner developed on the surface of the photoconductive element 1 contacts the intermediate transfer member 11. When the primary transfer roller 8 presses the intermediate transfer member 11, a developing bias is applied to the intermediate transfer member 11 and the toner is transferred from the photoconductive element 1 to the intermediate transfer member 11.

The intermediate transfer member 11 receives the toner image on its surface and moves in a direction indicated by an arrow in FIG. 1. This operation is repeated for four times until four colors of respective toner images corresponding to the photoconductive elements 1*a*, 1*b*, 1*c* and 1*d* are overlaid on the surface of the intermediate transfer member 11 to form a four color toner image.

When the intermediate transfer member 11 reaches a predetermined point along a paper path, the recording medium P is fed from one of the sheet feeding cassettes 21. When one of the corresponding pickup rollers 22 held in contact with the respective sheet stack is rotated, the recording medium P placed on a top of the sheet stack of recording media in one of the sheet feeding cassettes 21 is fed and is conveyed via sheet conveying paths 29 to a portion between rollers of a registration roller pair 28. The registration roller pair 28 stops and feeds the recording medium P in synchronization with a movement of the four color toner image towards a secondary transfer area that is formed at a portion between the intermediate transfer member 11 of the transfer unit 6 and the conveyance belt 100 of the secondary transfer mechanism.

The recording medium P is then conveyed to the fixing unit 30. After the recording medium P passes the fixing unit 30, the recording medium P is discharged by a sheet discharging roller 32 to a sheet discharging tray 40 provided at the upper portion of the image forming apparatus 200.

After the toner images are transferred from the surface of the intermediate transfer member 11 onto the recording medium P, a conveyance belt cleaning unit 250 including commonly known cleaning components such as a brush roller, a collection roller, and a cleaning blade removes residual toner and paper dust and collects thereto.

Figure 2:
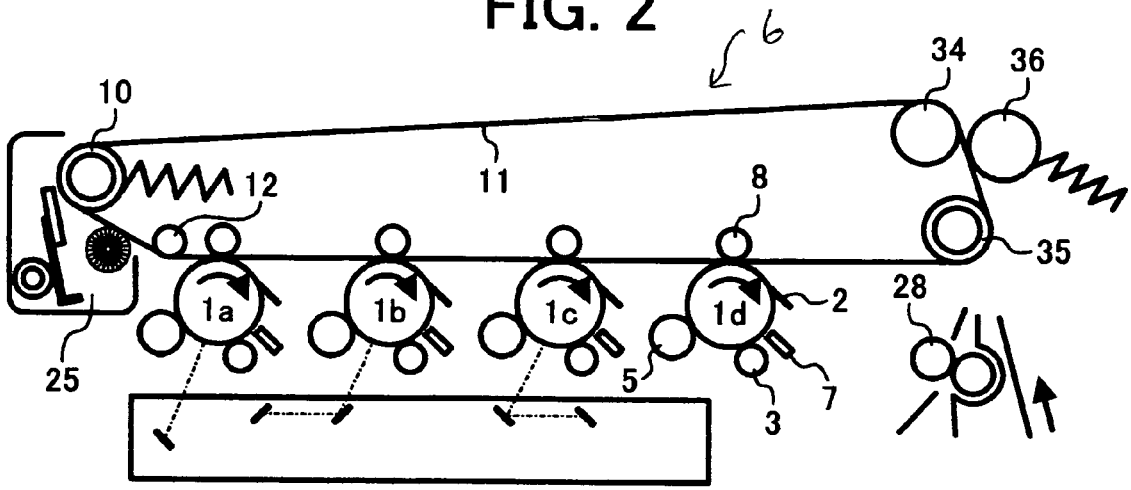
FIG. 2 is an enlarged view showing a transfer unit of the image forming apparatus shown in FIG. 1.

Referring to FIG. 2, a schematic structure of the transfer unit 6 and its peripheral units is described.

As previously described, the intermediate transfer member 11 forms an endless belt spanned around the tension roller 10, the drive roller 34, and the driven rollers 12 and 35, and rotates in a counterclockwise direction in FIG. 2.

The tension roller 10 is provided to further extend the intermediate transfer member 11. The tension roller 11 is disposed opposite to the intermediate transfer member cleaning unit 25.

The intermediate transfer member cleaning unit 25 removes residual toner remaining on the surface of the intermediate transfer member 11 after the secondary transferring operation.

The drive roller 34 is disposed opposite to the secondary transfer member 36.

As previously described, the photoconductive elements 1*a*, 1*b*, 1*c*, and 1*d* are held in contact with the intermediate transfer member 11 between the driven rollers 12 and 35.

Figure 3:
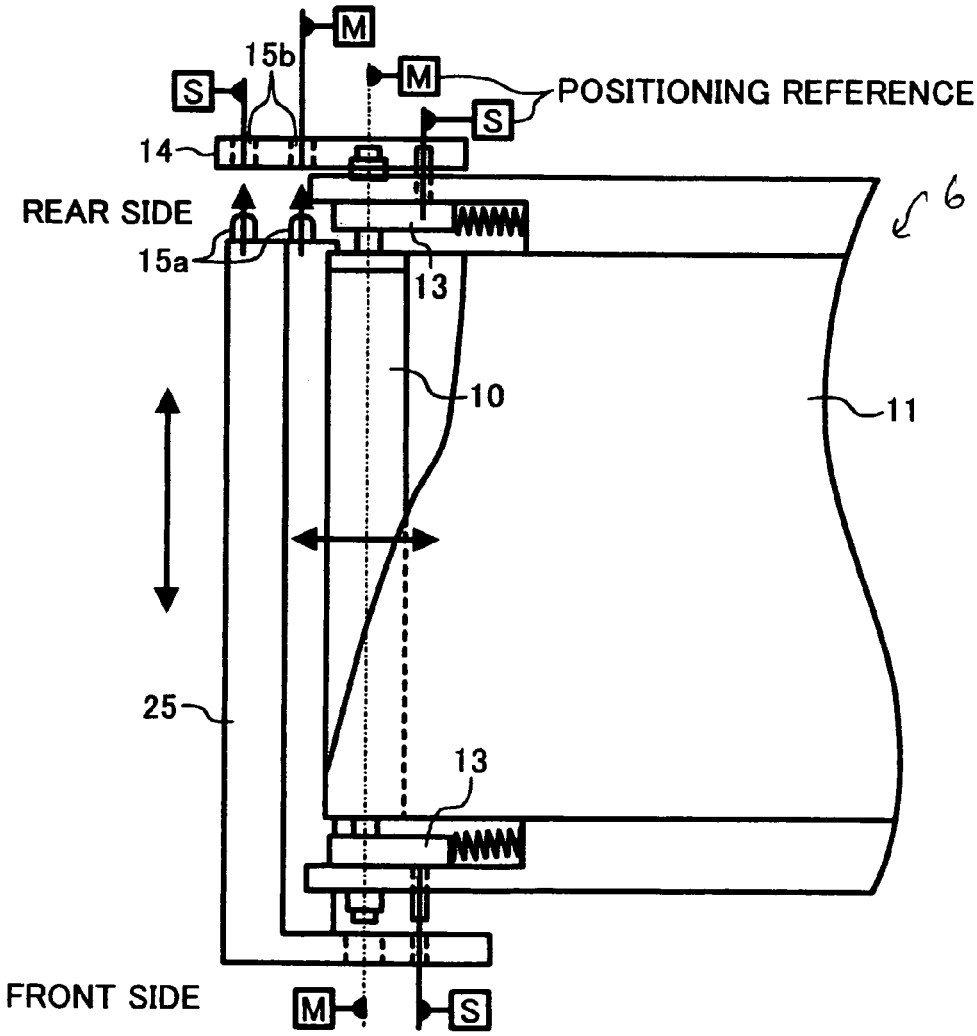
FIG. 3 is a top view of an intermediate transfer member cleaning unit with respect to an intermediate transfer member.

Referring to FIGS. 3 and 4, the intermediate transfer member cleaning unit 25 with respect to the intermediate transfer member 11 are described.

In FIGS. 3, 4A, 4B, and 4C, "M" stands for a main positioning reference of the intermediate transfer member cleaning unit 25, and "S" stands for a sub positioning reference of the intermediate transfer member cleaning unit 25.

The intermediate transfer member cleaning unit 25 is detachably disposed in the image forming apparatus 200 in the exemplary embodiment.

To avoid the build-up of positioning errors of the intermediate transfer member cleaning unit 25, it is preferable that an axial direction of the tension roller 10 can be a main positioning reference of the intermediate transfer member cleaning unit 25. The intermediate transfer member cleaning unit 25 may also have a sub positioning reference that are a combination of a boss and a detent provided such that a position of the intermediate transfer member cleaning unit 25 based on the main positioning reference may not be deviated.

In the exemplary embodiment, the tension roller 10 is pressed contact by an elastic member such as a spring (not shown). A tension roller holder 13 accommodates the tension roller 10, which helps the intermediate transfer member cleaning unit 25 be positioned according to the axial direction of the tension roller 10. However, the axial direction of the tension roller 10 cannot be a positioning reference for both ends of the intermediate transfer member cleaning unit 25 when the intermediate transfer member cleaning unit 25 is moved inwardly and outwardly. In that case, it is preferable that either end of the intermediate transfer member cleaning unit 25 is positioned according to a target position that is different from the axial direction of the tension-roller 10. The target position may preferably not interfere the intermediate transfer member 11 when the intermediate transfer member cleaning unit 25 is replaced to and from the image forming apparatus 200.

In FIG. 3, a positioning plate 14 is fixed to the tension roller holder 13 disposed on a rear side of the image forming apparatus 200 so that the positioning plate 14 can be a positioning reference of the intermediate transfer member 11 on the rear side.

When the positioning plate 14 and the tension roller holder 13 are integrally disposed, however, it may be difficult to replace the intermediate transfer member 11 to and from the image forming apparatus 200.

Consequently, the positioning plate 14 may be detachably disposed to the tension roller holder 13. Further, the intermediate transfer member cleaning unit 25 can be replaced by sliding into the image forming apparatus 200 in inward and outward directions of the image forming apparatus 200 as shown in FIGS. 3, 4A, 4B, and 4C. That is, the intermediate transfer member cleaning unit 25 can be inserted horizontally into the image forming apparatus 200 from a front side of the image forming apparatus 200 toward a rear side of the image forming apparatus 200. With the above-described structure, an end of the front side (or an outward end) of the intermediate transfer member cleaning unit 25 can be positioned directly with the tension roller holder 13, and an end of the rear side (or an inward end) of the intermediate transfer member cleaning unit 25 can be positioned with the positioning plate 14 that is detachably fixed to the tension roller holder 13.

When the positioning plate 14 is fixed to the tension roller holder 13, a main positioning reference of the positioning plate 14 is set to the axial direction of the tension roller 10. The intermediate transfer member cleaning unit 25 is the moved horizontally toward the tension roller 10 of the transfer unit 6 so that the intermediate transfer member cleaning unit 25 can be positioned without building up the positioning error.

Further, a position of the intermediate transfer member cleaning unit 25 with respect to the axial direction of the tension roller 10 can easily be replaced by engaging respective bosses 15*a* mounted on the intermediate transfer member cleaning unit 25 with respective detents 15*b* mounted on the positioning plate 14. The respective bosses 15*a* serve as a protruding member, and the respective detents 15*b* serve as a receiving member. The detents 15*b* includes a positioning reference detent and other detents to prevent rotations of the intermediate transfer member cleaning unit 25.

Alternatively, the bosses 15*a* can be mounted on the positioning plate 14, and the detents 15*b* can be mounted on the intermediate transfer member cleaning unit 25.

The position of the tension roller 10 may vary according to a change of the circumferential length of the intermediate transfer member 11. In that case, it is difficult to guide the intermediate transfer member cleaning unit 25 to the positioning plate 14 for replacement even though the image forming apparatus 200 is provided with a rail member (not shown).

Figure 4A:
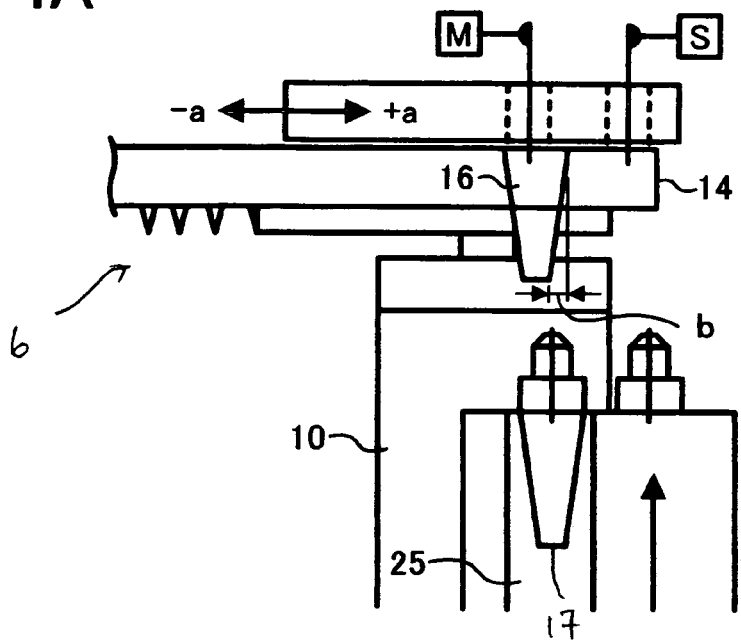
FIGS. 4A, 4B, and 4C show a process in which a positioning plate is engaged with the intermediate transfer member cleaning unit.
Figure 4B:
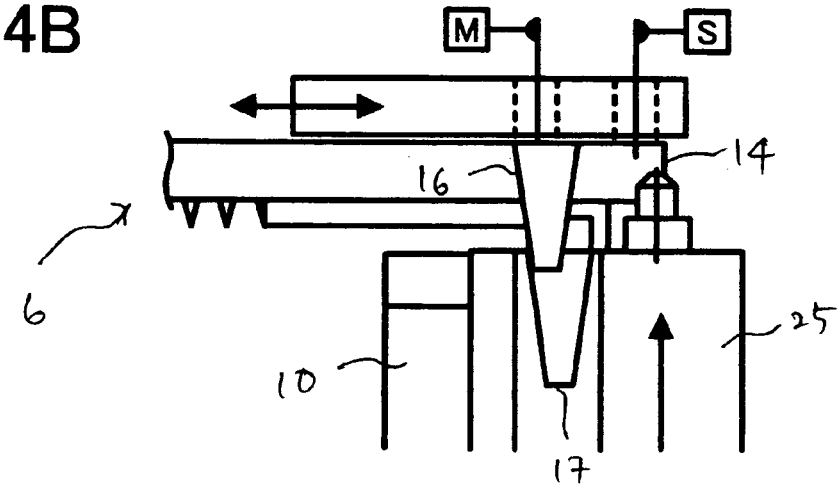
Figure 4C:
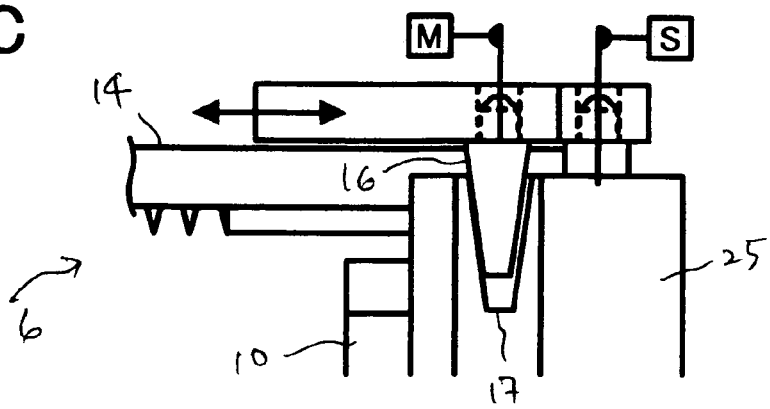

FIGS. 4A, 4B, and 4C show a process in which the positioning plate 14 having a guide member 16 is engaged with the intermediate transfer member cleaning unit 25 having a guide detent 17 to receive the guide member 16 of the positioning plate 14 so that the positioning member 14 can properly guide the intermediate transfer member cleaning unit 25.

The intermediate transfer member cleaning unit 25 may horizontally be moved from its center target point by an average travel distance "a" according to the move of the tension roller 10, as shown in FIG. 4A.

The guide member 16 is mounted on one side of the positioning plate 14 to face the intermediate transfer member cleaning unit 25. The shape of the guide member 16 is tapered toward the intermediate transfer member cleaning unit 25 so that the guide member 16 may have first and second distances from the center thereof, which are different by a distance "b".

When the intermediate transfer member cleaning unit 25 is horizontally moved toward the tension roller 10 of the transfer unit 6, the guide member 16 reaches the guide detent 17, as shown in FIG. 4B. When the guide member 16 is engaged with the guide detent 17, as shown in FIG. 4C, the intermediate transfer member cleaning unit 25 can be guided to the positioning reference.

When the distance "b" is smaller than the average travel distance "a", it is difficult for the guide member 16 to guide the intermediate transfer member cleaning unit 25 to the positioning reference.

In the present invention, the average travel distance "a" and the distance "b" have a relationship of $a \leqq b$. That is, when the tension roller 10 is moved due to a pressure applied to the tension roller 10 in a range of ±a from the main positioning reference of the tension roller 10, the intermediate transfer member cleaning unit 25 can be guided to the positioning plate 14.

Toner used in the image forming apparatus 200 including the intermediate transfer member cleaning unit 25 is produced by polymerization. The toner produced by polymerization is used, the toner particle may be substantially spherical and small. Therefore, it is difficult to remove toner remaining on an intermediate transfer member with a cleaning blade, which may deteriorate cleaning ability when the cleaning blade is worn due to aging.

To avoid the above-described problem, it is preferable that the cleaning blade is constantly replaced to maintain a predetermined amount of abrasion thereof. When a cleaning blade has a shorter life compared to the other parts, the intermediate transfer member cleaning unit 25 can integrally mounted with other parts to be replaced together. However, when the intermediate transfer member cleaning unit 25 is integrally mounted with other parts, the running cost may increase. To avoid the increase of the running cost of the image forming apparatus 200, there is a high demand that the intermediate transfer member cleaning unit 25 is replaced as a single unit. Thus, the image forming apparatus 200 of the present invention can increase the replaceability of the intermediate transfer member cleaning unit 25.

Now, the volume average particle diameter and the number average particle diameter of toner, which will be understood by those skilled in the art, are notated as Dv and Dn, respectively. Then, even if toner having a small particle diameter and a concentrated particle diameter distribution, such as toner having a Dv value of 3 through 8 μm and a ratio (Dv/Dn) of 1.00 through 1.40, is used, the developing unit 4 performs well.

When Dv/Dn is greater than 1.40, the charged amount distribution of the resultant toner widens and the toner produces images having deteriorated image resolution.

It is preferable that a shape factor "SF-1" of the toner used in the developing unit 4 is in a range from approximately 100 to approximately 180, and the shape factor "SF-2" of the toner is in a range from approximately 100 to approximately 180.

Figure 5A:
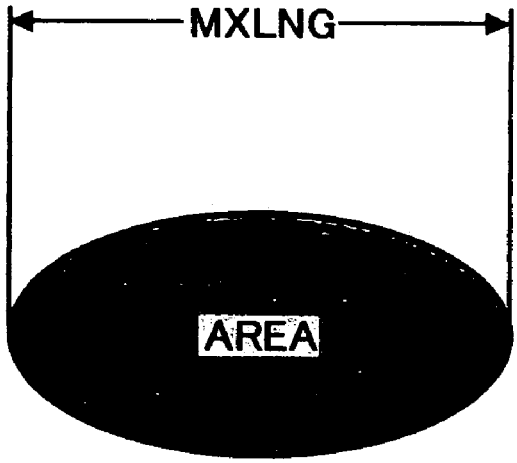
FIGS. 5A and 5B are schematic views showing exemplary toner shapes having "SF-1" and "SF-2" shapes, respectively.

Referring to FIG. 5A, the shape factor "SF1" is a parameter representing the roundness of a particle. The shape factor "SF-1" of a particle is calculated by a following Equation 1:

$$SF1=\{(MXLNG)^2/AREA\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 5B:
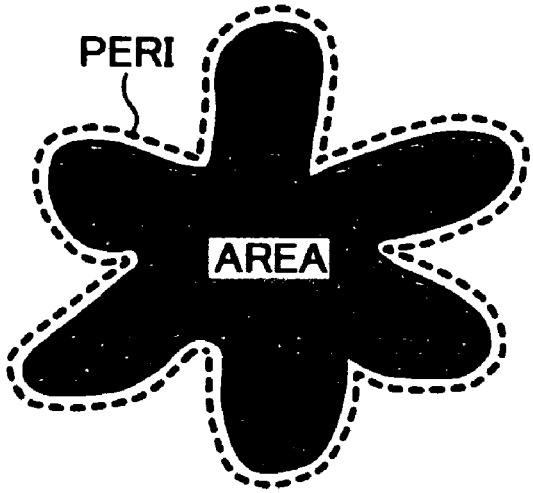

Referring to FIG. 5B, the shape factor "SF-2" is a value representing irregularity (i.e., a ratio of convex and concave portions) of the shape of the toner. The shape factor "SF-2" of a particle is calculated by a following Equation 2:

$$SF2=\{(PERI)^2/AREA\}\times(100\pi/4) \qquad \text{Equation 2,}$$

where "PERI" represents the perimeter of a FIG. obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As a toner particle has higher roundness, the toner particle is more likely to point-contact with another toner particle or the photoconductiv element 1. In this case, the adhesion force between these toner particles is weak, thereby making the toner particles highly flowable. Also, while weak adhesion force between the round toner particle and the photoconductive element 1 enhances the transfer rate, the round toner is more likely to cause cleaning malfunction for blade type cleaning. However, in this case, the intermediate transfer member cleaning unit 25 of the present invention can clean up the toner particles well. It is noted that large SF-1 and SF-2 values may deteriorate visual quality of an image due to scattered toner particles on the image. It is preferable that the SF-1 and SF-2 values be less than 180.

Toner for preferred use in an image forming apparatus according to the present invention is produced through bridge reaction and/or elongation reaction of a liquid toner material in aqueous solvent. Here, the liquid toner material is generated by dispersing polyester prepolymer including an aromatic group having at least nitrogen atom, polyester, a coloring agent, and a release agent in organic solvent. In the following, toner constituents and a toner manufacturing method are described in detail.

Toner constituents and preferable manufacturing method of the toner of the prevent invention will be described below.

(Polyester)

Polyester is produced by the condensation polymerization reaction of a polyhydric alcohol compound with a polyhydric carboxylic acid compound.

As the polyhydric alcohol compound (PO), dihydric alcohol (DIO) and polyhydric alcohol (TO) higher than trihydric alcohol can be used. In particular, a dihydric alcohol DIO alone or a mixture of a dihydric alcohol DIO with a small amount of polyhydric alcohol (TO) is preferably used. Specific examples of the dihydric alcohol (DIO) include alkylene glycol such as ethylene glycol, 1,2-propylene glycol, 1,3-propylene glycol, 1,4-butanediol, 1,6-hexanediol; alkylene ether glycol such as diethylene glycol, triethylene glycol, dipropylene glycol, polyethylene glycol, polypropylene glycol, polytetramethylene ether glycol; alicyclic diol such as 1,4-cyclohexane dimethanol, hydrogenated bisphenol A; bisphenols such as bisphenol A, bisphenol F, bisphenol S; adducts of the above-mentioned alicyclic diol with an alkylene oxide such as ethylene oxide, propylene oxide, butylenes oxide; adducts of the above-mentioned bisphenol with an alkylene oxide such as ethylene oxide, propylene oxide, butylenes oxide. In particular, alkylene glycol having 2 to 12 carbon atoms and adducts of bisphenol with an alkylene oxide are preferably used, and a mixture thereof is more preferably used. Specific examples of the polyhydric alcohol (TO) higher than trihydric alcohol include multivalent aliphatic alcohol having tri-octa hydric or higher hydric alcohol such as glycerin, trimethylolethane, trimethylolpropane, pentaerythritol and sorbitol; phenol having tri-octa hydric or higher hydric alcohol such as trisphenol PA, phenolnovolak, cresolnovolak; and adducts of the above-mentioned polyphenol having tri-octa hydric or higher hydric alcohol with an alkylene oxide.

As the polycarboxylic acid (PC), dicarboxylic acid (DIC) and polycarboxylic acids having 3 or more valences (TC) can be used. A dicarboylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyhydric alcohol (PO) and the polycarboxylic acid (PC) are mixed such that the equivalent ratio ([OH]/[COOH]) between the hydroxyl group [OH] of the poly hydric alcohol (PO) and the carboxylic group [COOH] of the polycarboxylic acid (PC) is typically from 2/1 to 1/1, preferably from 1.5/1 to 1/1 and more preferably from 1.3/1 to 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate compound (PIC) include aliphatic polyvalent isocyanate such as tetra methylenediisocyanate, hexamethylenediisocyanate, 2,6-diisocyanate methyl caproate; alicyclic polyisocyanate such as isophoronediisocyanate, cyclohexylmethane diisocyanate;

aromatic diisocyanate such as tolylenediisocyanate, diphenylmethene diisocyanate; aroma-aliphatic diisocyanate such as α,α,α',α',-tetramethylxylene diisocynate; isocaynates; the above-mentioned isocyanats blocked with phenol derivatives, oxime, caprolactam; and a combination of two or more of them.

The polyisocyanate compound (PIC) is mixed such that the equivalent ratio ([NCO]/[OH]) between an isocyanate group [NCO] and a hydroxyl group [OH] of polyester having the isocyanate group and the hydroxyl group is typically from 5/1 to 1/1, preferably from 4/1 to 1.2/1, and more preferably from 2.5/1 to 1.5/1. A ratio of [NCO]/[OH] higher than 5 can deteriorate low-temperature fixability. As for a molar ratio of [NCO] below 1, if the urea-modified polyester is used, then the urea content in the ester is low, lowering the hot offset resistance.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention may include a urea-modified polyesters. The urea-modified polyester may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of 150° C. to 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° C. to 140° C. to prepare a polyester prepolymer (A) having an isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the cross-linking reaction and/or extension reaction of a polyester prepolymer (A) with an amine (B), to control the molecular weight of the resultant urea-modified polyester. Specific examples of the reaction terminators include a monoamine such as diethylamine, dibutylamine, butylamine, lauryl amine, and blocked substances thereof such as a ketimine compound.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is not greater than 20,000, preferably from 1,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the full-color image forming apparatus 100, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 5/95 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of heat conserving resistance and low temperature fixability of the toner.

The toner binder preferably has a glass transition temperature (Tg) of from 45° C. to 65° C., and preferably from 45° C. to 60° C. When the glass transition temperature is less than 45° C., the heat conserving resistance of the toner deteriorates. When the glass transition temperature is higher than 65° C., the low temperature fixability deteriorates.

Since the urea-modified polyester can exist on the surfaces of the mother toner particles, the toner of the present invention has better heat conserving resistance than conventional toners including a polyester resin as a binder resin even though the glass transition temperature is low.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol-Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1 to 15% by weight, and more preferably from 3 to 10% by weight, based on total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

(Charge Controlling Agent)

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

(Releasing Agent)

A wax for use in the toner of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be improved without applying an oil to the fixing roller used. Specific examples of the releasing agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-lauryl-methacrylate and n-stearyl acrylate-ethyl methacrylate copolymers, can also be used.

These charge controlling agent and releasing agents can be dissolved and dispersed after kneaded upon application of heat together with a master batch pigment and a binder resin, and can be added when directly dissolved and dispersed in an organic solvent.

(External Additives)

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by a BET method is preferably from 20 to 500 $m^2/g$. The content of the external additive is preferably from 0.01 to 5% by weight, and more preferably from 0.01 to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination. Particularly, when such two kinds of fine grains, having a mean grain size of $5\times10^{-2}$ μm or below, are mixed together, there can be noticeably improved an electrostatic force and van del Waals force with the toner. Therefore, despite agitation effected in the developing unit for implementing the desired charge level, the fluidity imparting agent does not part from the toner grains and insures desirable image quality free from spots or similar image defects. In addition, there can be reduced the amount of residual toner.

Titanium oxide fine grains are desirable in environmental stability and image density stability, but tend to lower in charge start characteristics. Therefore, if the amount of titanium oxide fine particles is larger than the amount of silica fine grains, then the influence of the above side effect is considered to increase. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operation.

The method for manufacturing the toner is described.

The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, .alpha.-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium, 3-lomega-fluoroalkanoyl (C6-C8)-N-ethylamino}-1-propanesulfonate, fluoroalkyl (C11-C20)carboxylic acids and their metal salts, perfluoroalkylcarboxylic acids(7C-13C) and their metal salts, perfluoroalkyl(C4-C12)sulfonate and their metal salts, perfluorooctanesulfonic acid diethanol amides, N-propyl-N-(2-hydroxyethyl-)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16)e-thylphosphates, etc.

Specific examples of the marketed products of such surfactants having a fluoroalkyl group include SARFRON (Registered) S-111, S-112 and S-113, which are manufactured by ASAHI GLASS CO., LTD.; FLUORAD (Registered) FC-93, FC-95, FC-98 and FC-129, which are manufactured by SUMITOMO 3M LTD.; UNIDYNE (Registered) DS-101 and DS-102, which are manufactured by DAIKIN INDUSTRIES, LTD.; MEGAFACE (Registered) F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT (Registered) F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON (Registered) S-121 (manufactured by ASAHI GLASS CO., LTD.); FLUORAD (Registered) FC-135 (manufactured by SUMITOMO 3M LTD.); UNIDYNE DS-202 (manufactured by DAIKIN INDUSTRIES, LTD.); MEGAFACE (Registered) F-150 and F-824 (manufactured by DAINIPPON INK AND CHEMICALS, INC.); ECTOP EF-132 (manufactured by TOHCHEM PRODUCTS CO., LTD.); FUTARGENT (Registered) F-300 (manufactured by NEOS); etc.

Resin fine particles are added to stabilize toner source particles formed in aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, .alpha.-cyanoacrylic acid, .alpha.-cyanomethacrylic acid, itaconic acid, crotonic acid, fumaric acid, maleic acid and maleic anhydride), acrylic monomers having a hydroxyl group (e.g., .beta.-hydroxyethyl acrylate, .beta.-hydroxyethyl methacrylate, .beta.-hydroxypropyl acrylate, (.beta.-hydroxypropyl methacrylate, .gamma.-hydroxypropyl acrylate, .gamma.-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 to 20 μm. The number of rotation of the high speed shearing type dispersers is not particularly limited, but is usually 1,000 rpm (revolutions per minute) to 30,000 rpm, and preferably 5,000 to 20,000 rpm. While the dispersion time is not limited, it is usually 0.1 to 5 minutes for the batch system. The dispersion temperature is usually 0° C. to 150° C., and preferably 40 to 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge controlling agent is penetrated into the mother toner particles, and inorganic fine particles such as silica, titanium oxide etc. are added externally thereto to obtain the toner of the present invention.

In accordance with a well-known method, for example, a method using a mixer, the charge controlling agent is provided, and the inorganic particles are added.

Thus, a toner having a small particle size and a sharp particle size distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition between smooth surface and rough surface such as the surface of pickled plum.

Toner according to an embodiment of the present invention has a substantially spherical shape as in the following shape definition.

Figure 6A:
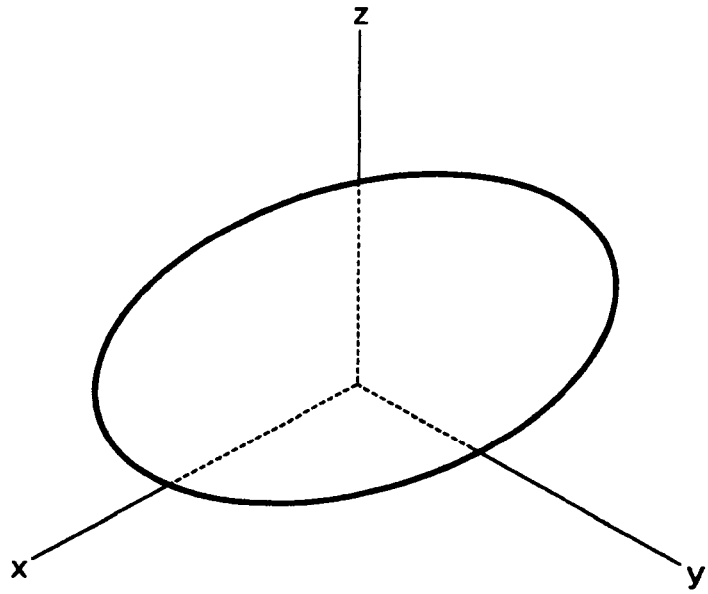
FIGS. 6A, 6B, and 6C show exemplary shapes of a toner particle according to an embodiment of the present invention.
Figure 6B:
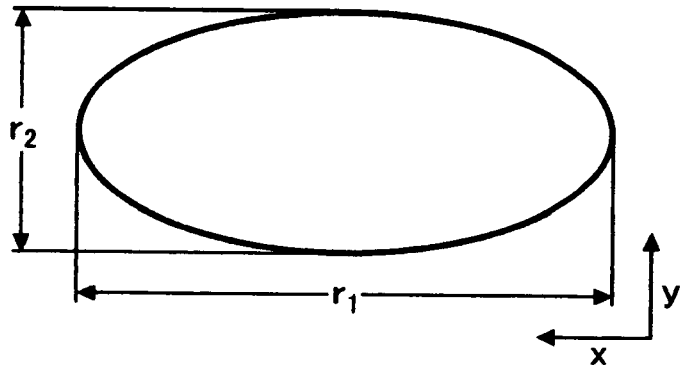
Figure 6C:
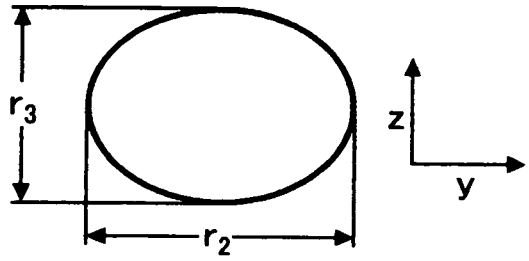

Referring to FIGS. 6A through 6C are schematic views showing an exemplary shape of a toner particle according to an embodiment of the present invention.

An axis x of FIG. 6A represents a major axis r1 of FIG. 6B, which is the longest axis of the toner. An axis y of FIG. 6A represents a minor axis r2 of FIG. 6C, which is the second longest axis of the toner. The axis z of FIG. 6A represents a thickness r3 of FIG. 6B, which is a thickness of the shortest axis of the toner. The toner has a relationship between the major and minor axes r1 and r2 and the thickness r3 as follows:

$$r1 \geqq r2 \geqq r3.$$

The toner of FIG. 6A is preferably in a spindle shape in which the ratio (r2/r1) of the major axis r1 to the minor axis r2 is approximately 0.5 to approximately 1.0, and the ratio (r3/r2) of the thickness r3 to the minor axis is approximately 0.7 to approximately 1.0.

It is noted that the lengths r1, r2 and r3 are measured by taking pictures of the toner particle from different viewing angles by using a scanning electron microscope (SEM).

According to the above-described structure, the cleaning unit 25 disposed opposite to the tension roller 10 can easily be detachable from the image forming apparatus 200 from the front side of the image forming apparatus 200 and can minimize a positioning error of the cleaning unit 25. The positioning plate 14 is detachable from the tension roller holder so that the intermediate transfer member 11 can easily be replaced.

Further, the cleaning unit 25 is provided to the image forming apparatus 200 so that the convenience of the image forming apparatus 200 can be improved.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

at least one image bearing member configured to bear an image;

an intermediate transfer member configured to transfer the image formed on the at least one image bearing member;

a roller configured to support the intermediate transfer member with tension;

a cleaning unit disposed opposite to the roller and configured to remove residual toner from the intermediate transfer member, the cleaning unit detachably disposed opposite to the roller, the cleaning unit comprises a guiding member receiving portion with a tapered portion and is configured to receive a guiding member;

a holder configured to accommodate the roller; and a positioning member detachably mounted on the holder and configured to position the cleaning unit, the positioning member comprises the guiding member with a tapered portion and is configured to guide the cleaning unit to a positioning reference.

2. The image forming apparatus according to claim 1, wherein the positioning reference is located along an axial direction of the roller.

3. The image forming apparatus according to claim 1, wherein the cleaning unit comprises a first engaging member and the positioning member comprises a second engaging member.

4. The image forming apparatus according to claim 3, wherein the first engaging member of the cleaning unit is configured to be engaged with the second engaging member of the positioning member.

5. The image forming apparatus according to claim 1, wherein the guiding member of the positioning member is configured to engage with the guiding member receiving portion of the cleaning unit and to guide the cleaning unit to the positioning reference.

6. The image forming apparatus according to claim 1, wherein:

the cleaning unit is configured to be horizontally moved from a center target point by a predetermined travel distance "a" according to a pressure applied by the roller and, the tapered portion has a first and second diameter, the second diameter being less than the first diameter by a predetermined distance "b".

7. The image forming apparatus according to claim 6, wherein the predetermined travel distance "a" and the predetermined distance "b" of the tapered portion of the guiding member have a relationship of $a \leqq b$.

8. The image forming apparatus according to claim 1, further comprising:

a developing mechanism configured to use toner having a volume-based average particle diameter from approximately 3 μm to approximately 8 μm and a distribution from approximately 1.00 to approximately 1.40; and the distribution is defined by a ratio of the volume-based average particle diameter to a number-based average diameter.

9. The image forming apparatus according to claim 1, further comprising:

a developing mechanism configured to use toner having a shape factor "SF-1" in a range from approximately 100 to approximately 180, and a shape factor "SF-2" in a range from approximately 100 to approximately 180.

10. The image forming apparatus according to claim 1, wherein:

the image forming apparatus is configured to use toner obtained from at least one of an elongation and a crosslinking reaction of toner composition comprising a polyester prepolymer having a function group including a nitrogen atom, a polyester, a colorant, and a releasing agent in an aqueous medium under resin fine particles.

11. The image forming apparatus according to claim 1, wherein:

the image forming apparatus is configured to use toner having a spindle outer shape.

12. The image forming apparatus according to claim 1, further comprising:

a developing mechanism configured to use toner having a ratio of a major axis r1 to a minor axis r2 from approximately 0.5 to approximately 1.0, and a ratio of a thickness r3 to the minor axis r2 from approximately 0.7 to approximately 1.0; and $r1 \geqq r2 \geqq r3$.

13. An image forming apparatus, comprising:

means for bearing an image;

means for transferring the image formed on the means for bearing;

means for supporting the means for transferring with tension;

means for removing residual toner from the means for transferring, the means for removing residual toner including a guiding member receiving portion having a tapered portion and configured to receive a guiding member;

means for accommodating the means for supporting; and means for positioning the means for removing to a reference position, the means for positioning detachably mounted on the means for accommodating, the means for positioning including the guiding member, the guiding member having a tapered portion and configured to guide the means for removing residual toner to a positioning reference.

14. A method of positioning a cleaning unit to an image forming apparatus, comprising:

mounting a positioning member detachably on a holder attached to a transfer unit of the image forming apparatus;

inserting the cleaning unit into the image forming apparatus horizontally from one side of the image forming apparatus to an opposite side of the image forming apparatus;

moving the cleaning unit horizontally toward the transfer unit;

engaging a guiding member of the positioning member with a guiding member receiving portion of the cleaning unit; and engaging a first engaging member of the cleaning unit with a second engaging member of the positioning member.

15. A cleaning unit detachably mounted on an image forming apparatus and disposed opposite to a roller supporting an intermediate transfer member, comprising:

a first engaging member configured to engage with a second engaging member included in a positioning member mounted on a holder accommodating the roller; and a guiding member receiving portion with a tapered portion configured to receive a guiding member mounted on the positioning member, wherein the cleaning unit is guided by the holder and the positioning member so that the cleaning unit is positioned.

16. The cleaning unit according to claim 15, wherein the positioning member is configured to position the cleaning unit to a reference position in an axial direction of the roller.

17. The cleaning unit according to claim 15, wherein the first engaging member of the cleaning unit is configured to be engaged with the second engaging member of the positioning member.

18. The cleaning unit according to claim 15, wherein the guiding member of the positioning member is configured to engage with the guiding member receiving portion of the cleaning unit and to guide the cleaning unit to a positioning reference.

19. The cleaning unit according to claim 15, wherein:

the cleaning unit is configured to be horizontally moved from a center target point by a predetermined travel distance "a" according to a pressure applied by the roller, and the guiding member has a tapered portion with a first and second diameter, the second diameter being less than the first diameter by a predetermined distance "b".

20. The cleaning unit according to claim 19, wherein the predetermined travel distance "a" and the predetermined distance "b" of the tapered portion of the guiding member have a relationship of $a \leqq b$.

21. A cleaning unit detachably mounted on an image forming apparatus and disposed opposite to a roller supporting an intermediate transfer member, comprising:

means for engaging the cleaning unit with means for positioning and means for accommodating the roller; and means for receiving a means for guiding of the means for positioning, wherein the cleaning unit is guided by the means for accommodating and the means for positioning so that the cleaning unit is positioned to a positioning reference.

* * * * *